US008545207B2

(12) United States Patent
Chang et al.

(10) Patent No.: US 8,545,207 B2
(45) Date of Patent: Oct. 1, 2013

(54) ROLLER TYPE ELECTROSTATIC SPINNING APPARATUS

(75) Inventors: Haw-Jer Chang, Tu-Chen (TW); Jen-Hsiung Lee, Taoyuan (TW); Yu-Chun Tang, Tu-Chen (TW); Tzu-Hsiang Huang, Sijhih (TW)

(73) Assignee: Taiwan Textile Research Institute, Tu-Chen, Taipei Hsien (TW)

( * ) Notice: Subject to any disclaimer, the term of this patent is extended or adjusted under 35 U.S.C. 154(b) by 262 days.

(21) Appl. No.: 12/971,201

(22) Filed: Dec. 17, 2010

(65) Prior Publication Data

US 2012/0003344 A1 Jan. 5, 2012

(30) Foreign Application Priority Data

Jun. 30, 2010 (TW) ..... 99121520 A

(51) Int. Cl.
*B29C 67/00* (2006.01)

(52) U.S. Cl.
USPC ..... 425/174.8 E; 425/174; 425/174.6; 425/174.8 R

(58) Field of Classification Search
USPC ..... 425/174.8 E, 174.8 R, 174, 174.6
See application file for complete search history.

(56) References Cited

U.S. PATENT DOCUMENTS

| | | | | |
|---|---|---|---|---|
| 2005/0104258 | A1* | 5/2005 | Lennhoff | 425/174.8 R |
| 2008/0150197 | A1 | 6/2008 | Chang et al. | |
| 2009/0127747 | A1 | 5/2009 | Green et al. | |
| 2009/0148547 | A1 | 6/2009 | Petras et al. | |
| 2010/0034914 | A1 | 2/2010 | Petras et al. | |

FOREIGN PATENT DOCUMENTS

| | | | |
|---|---|---|---|
| CN | 1849418 | A | 10/2006 |
| CN | 101189368 | A | 5/2008 |
| CN | 101512052 | A | 8/2009 |
| DE | 10136255 | A1 | 2/2003 |
| DE | 10136256 | A1 | 4/2003 |
| TW | 20082750 | | 7/2008 |

OTHER PUBLICATIONS

Theron et al, Electrostatic field-assisted alignment of electrospun nanofibers, 2001, Nanotechnology, 12, pp. 384-390.*

Yarin et al, Upward needleless electrospinning of multiple nanofibers, 2004, Polymer, 45, pp. 2977-2980.*

Google Dict. def. for terminal, Feb. 7, 2013, www.google.com/search?q=define%3A terminal&sourceid=ie7&rls=com.microsoft:en-us:IE-SearchBox&ie=&oe=#hl=en&tbo=u&rls=com.microsoft:en-us:IE-SearchBox&q=terminal&tbs=dfn:1&sa=X&ei=3scTUZW9PKyB0QGlp4HlBg&ved=0CC8QkQ4&bav=on.2,or.r_gc.r_pw.r_qf&bvm=bv.42080656,d.dmQ&fp=72bf9325becb8e42&biw=1600&bih=968.*

English translation of abstract and bibliographic data of DE 10136255 A1.

English language translation of abstract of TW 20082750 (published Jul. 1, 2008).

(Continued)

*Primary Examiner* — Timothy Kennedy

(74) *Attorney, Agent, or Firm* — McClure, Qualey & Rodack, LLP

(57) ABSTRACT

A roller type electrostatic spinning apparatus is disclosed, which includes an electrostatic spinning solution impregnation mechanism having a tank for containing an electrostatic spinning solution and a sizing roller rolled in the tank, a chain emitting electrode touching the sizing roller to coat the electrostatic spinning solution onto the chain emitting electrode, a collecting electrode, and a high-voltage power supply connected to the chain emitting electrode and the collecting electrodes respectively.

4 Claims, 5 Drawing Sheets

(56) References Cited

OTHER PUBLICATIONS

English language translation of abstract of CN 101512052 A (published Aug. 19, 2009).
English language translation of abstract of CN 101189368 A (published May 28, 2008).
English language translation of abstract of CN 1849418 A (published Oct. 18, 2006).
English language translation of abstract of DE 10136256 A1 (published Apr. 24, 2003).

* cited by examiner

210a

210b

210c

210d

210e

210f

210g

210h

210i

ROLLER TYPE ELECTROSTATIC SPINNING APPARATUS

RELATED APPLICATIONS

This application claims priority to Taiwan Application Serial Number 99121520, filed Jun. 30, 2010, which is herein incorporated by reference.

BACKGROUND

1. Field of Invention

The present invention relates to an electrostatic spinning apparatus. More particularly, the present invention relates to a roller type electrostatic spinning apparatus.

2. Description of Related Art

Electrostatic spinning technology can be used for manufacturing nanofibers. Electrostatic spinning technology provides a driving force generated by an electric field between an emitting electrode and a collecting electrode, so as to overcome surface tension and viscosity of the polymeric electrostatic spinning solution. In addition, fibers made by electrostatic spinning solution and spun from a spinneret repel each other because they are the same charge; when solvent evaporates, ultra-thin electrostatic spinning fibers can be formed.

Comparing to the fibers produced using prior spinning technology, the fabric made by electrostatic spinning method is featured by several properties, such as higher porosity, larger surface area, and smaller pore size than those of conventional textiles. The charged electrostatic spinning solution is spun to a collecting electrode from the spinneret. However, the aperture of the spinneret is very small and is easily blocked up by residual solution inside the spinneret. Moreover, the spinneret and pipe need to be cleaned when changing the electrostatic spinning solution. The applicability of the electrostatic spinning technique and the diversity of electrostatic spinning solutions are thus reduced.

TW Patent publication number 200827501 provides an electrostatic spinning apparatus, which is a roller type electrostatic spinning apparatus including a sizing roller and a linear emitting electrode to prevent unwanted block of spinneret. However, the threshold voltage of the roller type electrostatic spinning apparatus is higher than the conventional spinneret type electrostatic spinning apparatus, and the spinning uniformity is difficult to improve due to the large width of the linear emitting electrode.

Therefore, there is a need to overcome the above disadvantages of the roller type electrostatic spinning apparatus.

SUMMARY

An aspect of the invention is providing a roller type electrostatic spinning apparatus, which includes an electrostatic spinning solution impregnation mechanism having a tank for containing an electrostatic spinning solution and a sizing roller rolled in the tank, a chain emitting electrode touching the sizing roller to coat the electrostatic spinning solution onto the chain emitting electrode, a collecting electrode, and a high-voltage power supply connected to the chain emitting electrode and the collecting electrodes respectively.

The chain emitting electrode can be a bead chain. The bead chain includes plural beads and a line for connecting the beads. The section shape of each of the plurality of beads can be a circle, a disk, an ellipse, a square, a polygon, or an irregular shape. The maximum diameter of each bead is from 0.5 mm to 20 mm. The chain emitting electrode can include plural rings, and the rings are coupled one by one. The shape of each ring can be a circle, a disk, an ellipse, a square, a polygon, or an irregular shape. The maximum diameter of each of the rings is from 0.5 mm to 20 mm. The chain emitting electrode includes a plurality of disks, and the plurality of disks are coupled one by one. The chain emitting electrode includes plural protrusions, and plural gaps formed between the protrusions. The chain emitting electrode can be static during touching the sizing roller. The chain emitting electrode can be rotated during touching the sizing roller. The material of the chain emitting electrode can be a conductor or a non-conductor.

The threshold voltage of the roller type electrostatic spinning apparatus using the chain emitting electrode is smaller than the threshold of the roller type electrostatic spinning apparatus using the linear emitting electrode. The roller type electros spinning apparatus using the chain emitting electrode may achieve the goal of uniform and static large width electros spinning.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE EMBODIMENTS

Figure 1:
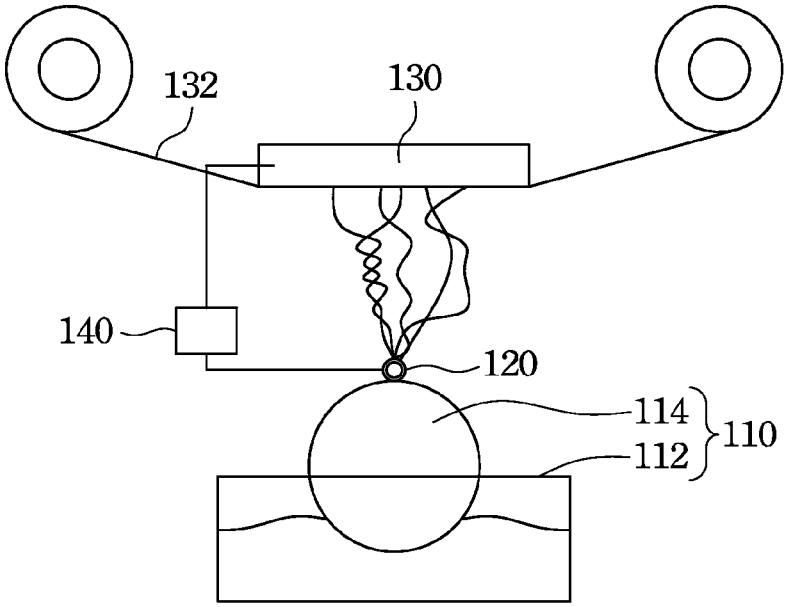
FIG. 1 is a schematic diagram of an embodiment of the roller type electrostatic spinning apparatus of the invention.

Reference will now be made in detail to the present embodiments of the invention, examples of which are illustrated in the accompanying drawings. Wherever possible, the same reference numbers are used in the drawings and the description to refer to the same or like parts.

Refer to FIG. 1. FIG. 1 is a schematic diagram of an embodiment of the roller type electrostatic spinning apparatus of the invention. The roller type electrostatic spinning apparatus 100 includes an electrostatic spinning solution impregnation mechanism 110, a chain emitting electrode 120, a collecting electrode 130, and a high-voltage power supply 140. The electrostatic spinning solution impregnation mechanism 110 includes a tank 112 and a sizing roller 114. An electrostatic spinning solution is contained in the tank 112. The sizing roller 114 is rotated in the tank 112, and the electrostatic spinning solution can be coated on the sizing roller 114. The chain emitting electrode 120 touches the sizing roller 114, and the electrostatic spinning solution can be further coated onto the chain emitting electrode 120. The material of the sizing roller 114 is nonconductor. The material of the chain emitting electrode 120 can be conductor or nonconductor. The chain emitting electrode 120 can be static during touching the sizing roller 114. The chain emitting electrode 120 can be rotating during touching the sizing roller 114. The sizing roller 114 is touched by one chain emitting electrode in this embodiment. The sizing roller 114 can be touched by plural chain emitting electrodes 120 in other embodiment.

The high-voltage power supply 140 is connected to the chain emitting electrode 120 and the collecting electrode 130 to oppositely charge the chain emitting electrode 120 and the collecting electrode 130. In this embodiment, the chain emitting electrode 120 is charged positively and the collecting electrode 130 is charged negatively by the high-voltage power supply 140. The chain emitting electrode 120 may touch the sizing roller 114 to coat the electrostatic spinning solution contained in the tank 112 through the sizing roller 114 rolled in the tank 112. The electrostatic spinning solution on the chain emitting electrode 120 is repelled by the high-voltage like charge and may be separated from the sizing roller 114 and then scattered. The positively charged electrostatic spinning solution may be attracted by the negatively charged collecting electrode 130 and the electrostatic spinning solution may be led to the collecting electrodes 130 and form an electrostatic spinning fiber. The electrostatic spinning fiber is collected by the collecting electrode 130 to form an electrostatic spinning fabric.

The collecting electrode 130 of the roller type electrostatic spinning apparatus 100 can be a plate electrode or a curved electrode. The roller type electrostatic spinning apparatus 100 can further include a conveyer belt 132 disposed between the collecting electrode 130 and the chain emitting electrode 120. The conveyer belt 132 is disposed close to the collecting electrode 130 to collect the electrostatic spinning fabric, which is led to the collecting electrode 130. The conveyer 132 may include a textile, and the electrostatic spinning fabric can combine with the textile to form a complex textile.

Figure 2:
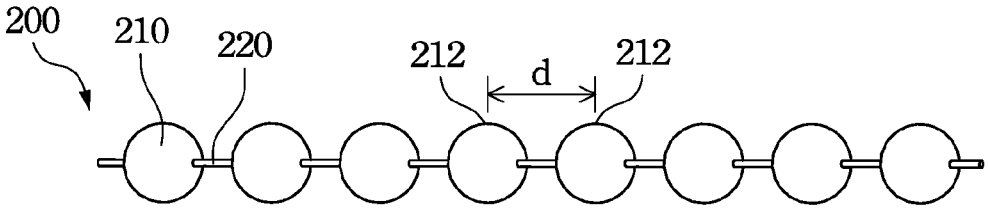
FIG. 2 is a schematic diagram of a first embodiment of the chain emitting electrode of the roller type electrostatic spinning apparatus of the invention.

Refer to FIG. 2. FIG. 2 is a schematic diagram of a first embodiment of the chain emitting electrode of the roller type electrostatic spinning apparatus of the invention. The chain emitting electrode 200 is a bead chain. The chain emitting electrode 200 includes plural beads 210 and a line 220 for connecting the beads 210. The diameter of each bead 210 in this embodiment is approximately the same. The beads 210 can be fixed on the line 220, and the position of the beads 210 can be fixed. The line 220 can pass through the beads 210, and the beads 210 can be slid relative to the line 220. The material of the beads 210 can be conductor or nonconductor. The material of the line 220 can be conductor or nonconductor.

Each of the beads 210 is a solid structure and has a protrusion 212, and a gap d is formed between adjacent two of the protrusions 212 respectively. The beads 210 of the chain emitting electrode 200 have the protrusions 212, therefore the electrostatic solution is likely to be spun and emitted from the protrusions 212. Thus, the threshold voltage for forming the electrostatic spinning fiber can be reduced. Besides, the protrusions 212 of the beads 210 are arranged uniformly on the chain emitting electrode 200, and the electrostatic solution would tend to be spun from the protrusions 212, thus the electrostatic solution can be spun uniformly and statically to achieve the goal of large width and uniform electrostatic spinning.

See the following examples. In the following examples, the electrostatic spinning solution is 12 wt % PVA. The distance between the sizing roller and the collecting electrode is 12.5 cm. The width of the emitting electrode is 160 cm. The threshold voltage is 110 kV when the emitting electrode is a linear emitting electrode with the diameter of 1.5 mm; the threshold voltage is 85 kV when the emitting electrode is the bead chain emitting electrode with the bead diameter of 1.5 mm; the threshold voltage is 93 kV when the emitting electrode is the bead chain emitting electrode with the bead diameter of 2.4 mm; the threshold voltage is 91 kV when the emitting electrode is the bead chain emitting electrode with the bead diameter of 3.0 mm. According to the above examples, the threshold voltage of the roller type electrostatic spinning apparatus using the chain emitting electrode is smaller than the threshold voltage of the roller type electrostatic spinning apparatus using the linear emitting electrode.

Figure 3A:
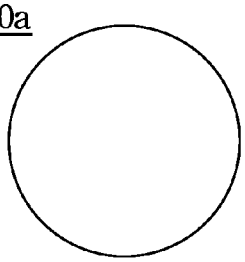
FIG. 3A to FIG. 3E are cross-section diagrams of different embodiments of the bead of the chain emitting electrode of the invention.
Figure 3B:
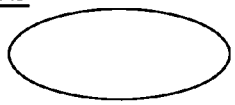
Figure 3C:
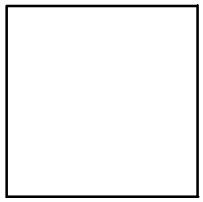
Figure 3D:
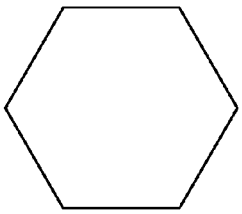
Figure 3E:
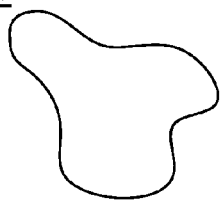
Figure 3F:
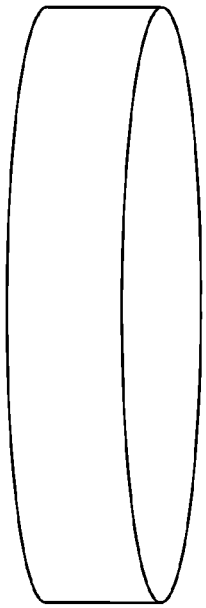
FIG. 3F to FIG. 3I are oblique diagrams of different embodiments of the bead of the chain emitting electrode of the invention.
Figure 3G:
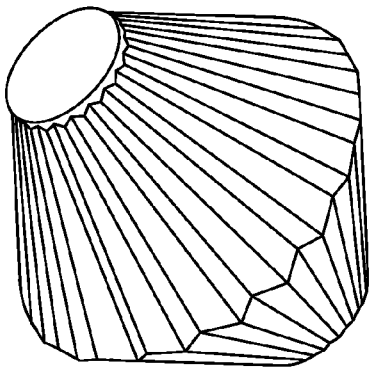
Figure 3H:
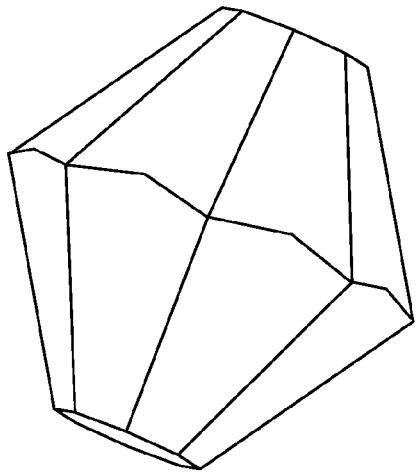
Figure 3I:
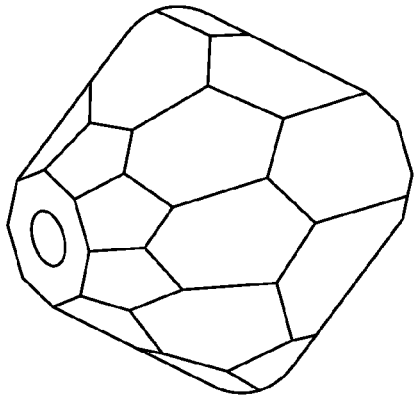

Refer to FIG. 3A to FIG. 3E. FIG. 3A to FIG. 3B are cross-section diagrams of different embodiments of the bead of the chain emitting electrode of the invention. The section shape of the bead 210*a* in FIG. 3A is a circle. The section shape of the bead 210*b* in FIG. 3B is an ellipse. The section shape of the bead 210*c* in FIG. 3C is a square. The section shape of the bead 210*d* in FIG. 3D is a polygon. The section shape of the bead 210*e* in FIG. 3E is an irregular shape.

Refer to FIG. 3F to FIG. 3I. FIG. 3F to FIG. 3I are oblique diagrams of different embodiments of the bead of the chain emitting electrode of the invention. The bead 210*f* in FIG. 3F can be a plate structure. The beads 210*g*, 210*h*, and 210*i* in FIG. 3G to FIG. 3I can be polyhedron with notches.

The beads 210 of the bead chain type chain emitting electrode 200 in FIG. 2 can have same shape or different shape. The section shape of the beads 210 can be a circle, a disk, an ellipse, a square, a polygon, or an irregular shape. A maximum diameter of the beads 210 is from 0.5 mm to 20 mm. The size of the beads 210 of the chain emitting electrode can be same or different. The material of the bead 210 can be conductor or nonconductor.

Figure 4:
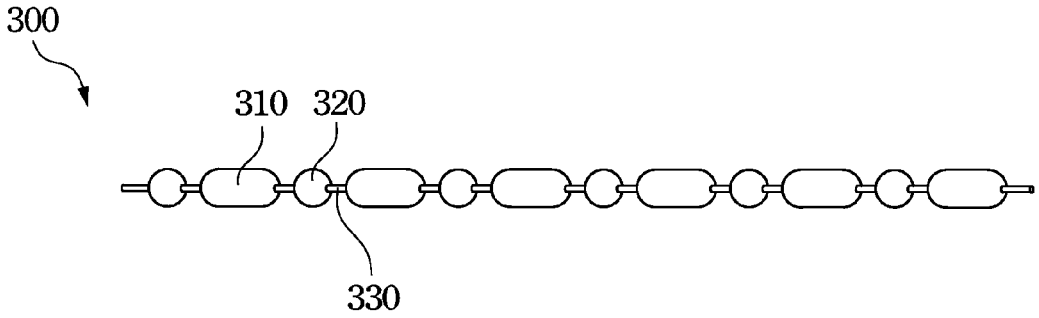
FIG. 4 is a schematic diagram of a second embodiment of the chain emitting electrode of the invention.

Refer to FIG. 4. FIG. 4 is a schematic diagram of a second embodiment of the chain emitting electrode of the invention. The chain emitting electrode 300 includes plural first beads 310, plural second beads 320, and a line 330 for connecting the first beads 310 and the second beads 320. The section shape of the first beads 310 can be different from the section shape of the second beads 320. The maximum diameter of the first beads 310 can be different from the maximum diameter of the second beads 320.

Figure 5:
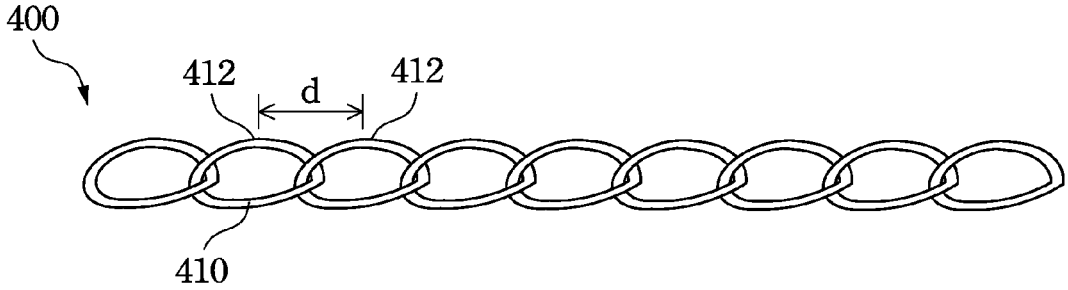
FIG. 5 is a schematic diagram of a third embodiment of the chain emitting electrode of the invention.

Refer to FIG. 5. FIG. 5 is a schematic diagram of a third embodiment of the chain emitting electrode of the invention. The chain emitting electrode 400 includes plural rings 410. The rings 410 are connected one by one. The shape of the rings 410 can be a circle, an ellipse, a triangle, a polygon, a drop or an irregular shape. The size and the shape of each ring 410 are the same in this embodiment. The chain emitting electrode 400 can be formed by connecting more than two kinds of rings 410 in other embodiment. The maximum diameter of the rings 410 is form 0.5 mm to 20 mm. The material of rings 410 can be conductor or nonconductor.

Each ring 410 has a protrusion 412. A gap d is formed between adjacent two of the protrusions 412. The rings 410 of the chain emitting electrode 400 have the protrusions 412, therefore the electrostatic solution is likely to be spun and emitted from the protrusions 412. Thus the threshold voltage for forming the electrostatic spinning fiber can be reduced. Besides, the protrusions 412 of the rings 410 are arranged uniformly on the chain emitting electrode 400, and the electrostatic solution would tend to be spun from the protrusions 412, thus the electrostatic solution can be spun uniformly and statically to achieve the goal of large width and uniform electrostatic spinning.

Figure 6:
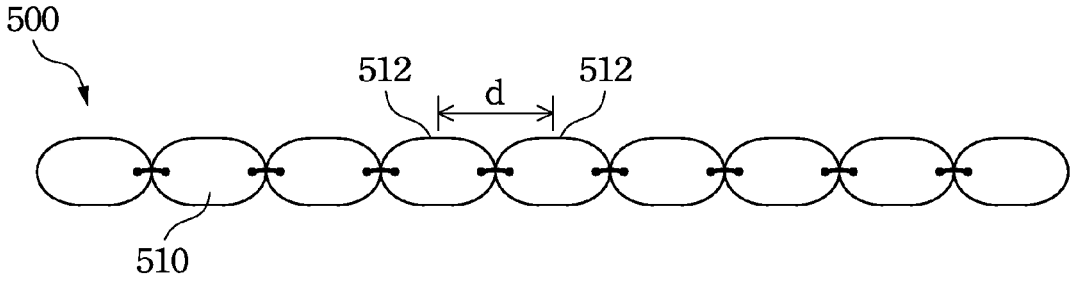
FIG. 6 is a schematic diagram of a fourth embodiment of the chain emitting electrode of the invention.

Refer to FIG. 6. FIG. 6 is a schematic diagram of a fourth embodiment of the chain emitting electrode of the invention. The chain emitting electrode 500 includes plural disks 510. The disks 510 are connected one by one. The shape of the disks 510 can be a circle, an ellipse, a triangle, a polygon, a drop or an irregular shape. The size and the shape of each disk 510 are the same in this embodiment. The chain emitting electrode 500 can be formed by connecting more than two kinds of disks 510 in other embodiment. The maximum diameter of the disks 510 is form 0.5 mm to 20 mm. The material of disks 510 can be conductor or nonconductor.

Each disk 510 has a protrusion 512. A gap d is formed between adjacent two of the protrusions 512. The disk 510 of the chain emitting electrode 500 have the protrusions 512, therefore the electrostatic solution is likely to be spun and emitted from the protrusions 512. Thus the threshold voltage for forming the electrostatic spinning fiber can be reduced. Besides, the protrusions 512 of the disks 510 are arranged uniformly on the chain emitting electrode 500, and the electrostatic solution would be tend to being spun from the protrusions 512, thus the electrostatic solution can be spun uniformly and statically to achieve the goal of large width and uniform electrostatic spinning.

According to the above embodiments, the threshold voltage of the roller type electrostatic spinning apparatus using the chain emitting electrode is smaller than the threshold of the roller type electrostatic spinning apparatus using the linear emitting electrode. The roller type electros spinning apparatus using the chain emitting electrode may achieve the goal of uniform and static large width electrostatic spinning.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A roller type electrostatic spinning apparatus comprising:

an electrostatic spinning solution impregnation mechanism comprising a tank for containing an electrostatic spinning solution and a sizing roller rolled in the tank;

a chain emitting electrode touching the sizing roller to coat the electrostatic spinning solution onto the chain emitting electrode, wherein the chain emitting electrode is disposed parallel to an axis of rotation of the sizing roller, wherein the chain emitting electrode comprises a bead chain, the bead chain comprises a plurality of beads and a line for connecting the beads, and a maximum diameter of each of the plurality of beads is from 1.5 mm to 3.0 mm;

a collecting electrode; and a high-voltage power supply directly connected to the chain emitting electrode and the collecting electrode.

2. The roller type electrostatic spinning apparatus of claim 1, wherein the chain emitting electrode is static during touching the sizing roller.

3. The roller type electrostatic spinning apparatus of claim 1, wherein the chain emitting electrode is rotating during touching the sizing roller.

4. The roller type electrostatic spinning apparatus of claim 1, wherein the material of the chain emitting electrode is a conductor or a nonconductor.

* * * * *